United States Patent [19]

Ichikawa et al.

[11] Patent Number: 4,865,808

[45] Date of Patent: Sep. 12, 1989

[54] METHOD FOR MAKING HYPEREUTETIC AL-SI ALLOY COMPOSITE MATERIALS

[75] Inventors: Kiyoshi Ichikawa, Tsukuba; Satoshi Ishizuka; Shinji Yamamoto, both of Hamamatsu, all of Japan

[73] Assignees: Agency of Industrial Science and Technology, Tokyo; Suzuki Motor Co., Ltd., Shizuoka, both of Japan

[21] Appl. No.: 175,217

[22] Filed: Mar. 30, 1988

[30] Foreign Application Priority Data

Mar. 30, 1987 [JP] Japan ..... 62-79425
Oct. 8, 1987 [JP] Japan ..... 62-254345

[51] Int. Cl.[4] ..... C22C 1/09; C22C 1/10

[52] U.S. Cl. ..... 428/548; 148/415; 420/528; 420/590; 428/614

[58] Field of Search ..... 420/528, 548, 590, 129

[56] References Cited

U.S. PATENT DOCUMENTS 3,951,651 4/1976 Mehrabian et al. ..... 420/590
3,954,455 5/1976 Flemings et al. ..... 420/590
4,636,355 1/1987 Ichikawa ..... 420/590

*Primary Examiner*—L. Dewayne Rutledge
*Assistant Examiner*—David Schumaker
*Attorney, Agent, or Firm*—Oblon, Spivak, McClelland, Maier & Neustadt

[57] ABSTRACT

An easy method and apparatus to eliminate casting defects from composite materials of hypereutectic Al-Si alloys and improve their properties. The product composite materials with primary silicon crystals of several microns have fine homogeneous microstructures and mechanical properties comparable to similar materials produced by the conventional powder metallurgy technology. Highly wear-resistant composite materials, in which the hypereutectic Al-Si alloy and strengthening material are homogeneously mixed, can be obtained with ease. The hypereutectic Al-Si alloy and strengthening material are homogeneously mixed by stirring blades rotated at low speed. The obtained molten composite alloy rotated at high speed about a horizontal shaft in a heat-resistant vessel. The rotor rotating and stirring at high speed spatters the molten composite alloy material to break up the crystallizing out primary silicon crystals. The rotor stirs the spattered semi-solid composite alloy material received by the heat-resistant vessel. A resulting semi-solid mass having a fine-grained homogeneous microstructure is recovered as the final product.

7 Claims, 3 Drawing Sheets

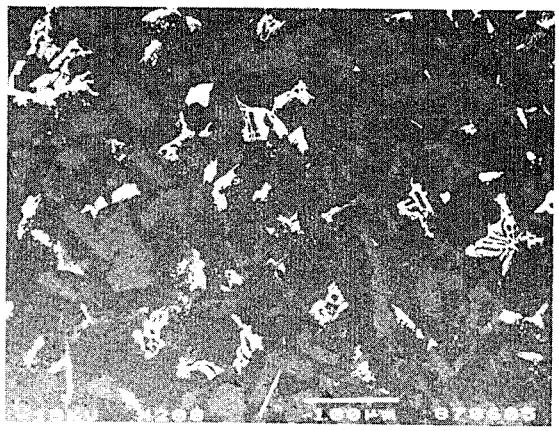
100 μm

METHOD FOR MAKING HYPEREUTETIC AL-SI ALLOY COMPOSITE MATERIALS

FIELD OF THE INVENTION

This invention relates to a method and apparatus for making wear-resistant hypereutectic aluminum-silicon (Al-Si) alloy composite materials strengthened by dispersing particles or adding fibers.

DESCRIPTION OF THE PRIOR ART

Hypereutectic Al-Si alloy castings are known as aluminum alloys having the highest degree of wear resistance. Involving unavoidable casting defects, however, the alloys do not have high enough mechanical properties and, therefore, are difficult to forge and often unsuitable for precision machining.

The Compocast technology (U.S. Pat. No. 3,936,298) is a known casting method that makes a homogeneous strengthened composite material of hypereutectic Al-Si alloy by adding strengthening nonmetallic particles to an alloy material in a solid-liquid coexisting state while mechanically stirring with rotary blades. There is also a powder metallurgy technique (U.S. Pat. No. 2,972,529, Trans. AIME, 1(1970), p. 2943) that sinters a homogeneous mixture of a powder of fine-grained particles prepared by rapid solidification rate process or other methods with a strengthening nonmetallic powder.

With the rotational speed of the rotary blades being held below 1,000 rpm, the Compocast method is incapable of achieving homogeneous refining of crystalline grains and uniform dispersion of particles or fibers. The blades rotated in a reducing atmosphere or in the atmosphere are likely to entrap inert gas and air. Therefore, mechanical properties of the obtained material are not very much improved.

The material obtained by the powder metallurgy technique is costly because of the complex manufacturing process and large-scale equipment involved.

As such, none of the conventional techniques readily permits elimination of casting defects and improvement of material properties.

When hypereutectic Al-Si alloy is mixed with strengthening nonmetallic particles or fibers, furthermore, the added particles or fibers do not uniformly mix with the molten alloy but tend to separate therefrom because of differences in their specific gravities. Even if once uniformly mixed with the molten alloy by mechanical stirring, such strengthening materials will separate out when crystals are formed as the mixture solidifies.

OBJECTS OF THE INVENTION

An object of this invention is to provide an easy method and apparatus for making wear-resistant composite materials of hypereutectic Al-Si alloys with improved properties and without casting defects, or, more particularly, with fine homogeneous microstructures and excellent mechanical properties comparable to those of materials obtained by the powder metallurgy technology by reducing the size of the primary silicon crystrals crystallized out to several microns.

Another object of this invention is to provide a simple method and apparatus for making, at low cost, wear-resistant composite materials of hypereutectic Al-Si alloys with fine homogeneous microstructures and excellent mechanical properties comparable to those of materials obtained by the powder metallurgy technology by refining the primary silicon crystals crystallized out by homogeneous mixing of the molten metal and casting with high-speed rotational stirring, without powdering the alloy as in the conventional powder metallurgy process.

Still another object of this invention is to provide a method and apparatus for making homogeneous composite materials of hypereutectic Al-Si alloys with improved wear-resistance by highly uniformly mixing the hypereutectic Al-Si alloys with strengthening materials.

Yet another object of this invention is to provide a simple method and apparatus for continuously making composite materials of hypereutectic Al-Si alloys at much lower cost than similar materials made by powder metallurgy and having better mechanical properties than those made by the Compocast technique by simultaneously perfoming such homogeneous mixing of fine-grained crystalline grains and nonmetallic strengthening materials as is achieved by powder metallurgy in the casting process thereof.

SUMMARY OF THE INVENTION

To achieve the above objects, a method of making composite materials of hypereutectic Al-Si alloys according to this invention comprises the steps of homogeneously mixing a strengthening material of nonmetallic particles or fibers with a hypereutectic Al-Si alloy melted in a melting furnace contained in a vacuum vessel by means of stirring blades rotated at low speed, dropping the obtained molten composite material of the hypereutectic Al-Si alloy onto a polygonal rotor that rotates at high speed about a horizontal shaft in a heat-resistant vessel, breaking up the crystallizing out primary silicon crystals by spattering the molten composite material by the stirring action of the rotor rotating at high speed, receiving the spattered semifused composite material with the heat-resistant vessel, and making the composite material into a semi-solid mass having a fine-grained homogeneous microstructure by stirring the composite material with the rotor.

Examples of the strengthening material of nonmetallic particles or fibers added in the method of this invetion are particles of graphite and titanium carbide and short fibers of graphite. The amount of addition should preferably be held between 3 percent and 8 percent by weight.

To achieve the above objects, an apparatus for making composite materials of hypereutectic Al-Si alloys according to this invention comprises an alloy melting furnace contained in a vacuum vessel, the melting furnace having stirring blades rotated at low speed by a drive unit, an addition hopper to feed a strengthening material of nonmetallic particles or fibers to the molten alloy, a taphole through which the mixed molten composite material is poured down, a taphole open-close device to open and close the taphole from outside the vacuum vessel, a stirrer to receive the molten composite material poured down through the taphole, a rotor having a polygonal cross section that rotates at high speed to stir and spatter the molten composite material, and a heat-resistant vessel containing the rotor, receiving the molten composite material spattered therefrom, and pouring the collected material down into a mold through a small-diameter hole provided therein.

In this apparatus, the melting furnace melts a hypereutectic Al-Si alloy, which is a matrix metal, in a vacuum. The stirring blades rotating at low speed mixes the alloy homogeneously with a strengthening material of nonmetallic particles or fibers fed from the addition hopper. After the mixed material has been sufficiently stirred, the open-close device is actuated to open the taphole to pour the mixed molten composite material down into the stirrer below.

In the stirrer, the rotor rotating at high speed repeatedly spatters the molten composite material. With the crystalline grains thus refined and the strengthening material of nonmetallic particles or fibers homogeneously dispersed, a semi-solid or viscous slurry of the metalmatrix composite material is obtained. The slurry is poured through a small-diameter hole in the bottom into a mold to form an ingot. Such fine-grained crystals and homogeneous mixing of the strengthening material of nonmetallic particles or fibers as are obtained by powder metallurgy can be attained simultaneously in the casting process of this invention which continuously yields a composite material having excellent mechanical properties.

BRIEF DESCRIPTION OF THE DRAWINGS

FIG. 3 is a photomicrograph showing the microstructure of an alloy-matrix composite material made by use of the method and apparatus according to this invention.

DESCRIPTION OF THE PREFERRED EMBODIMENT

Figure 1:
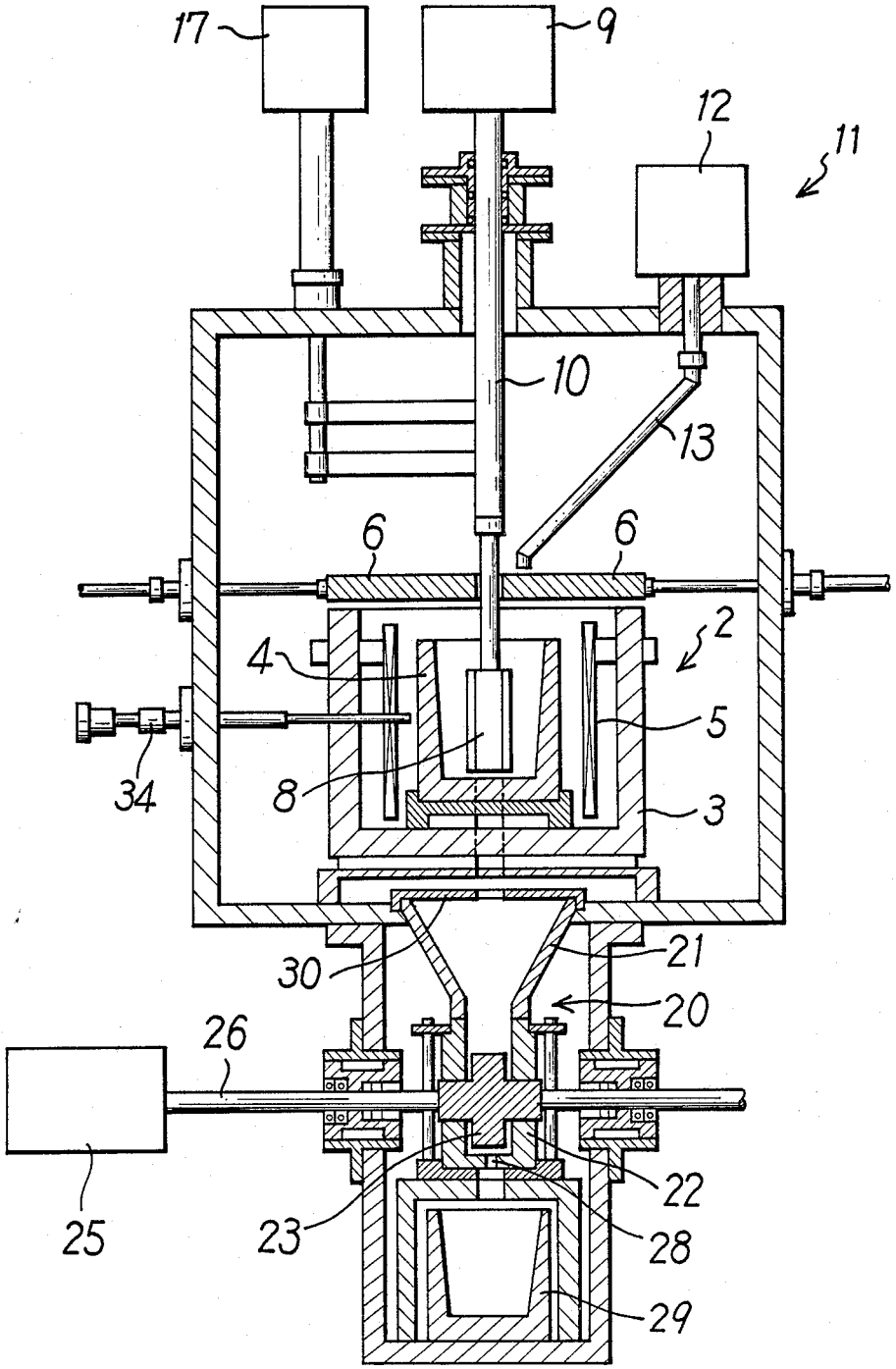
FIG. 1 is a cross-sectional front view of an apparatus according to this invention.
Figure 2:
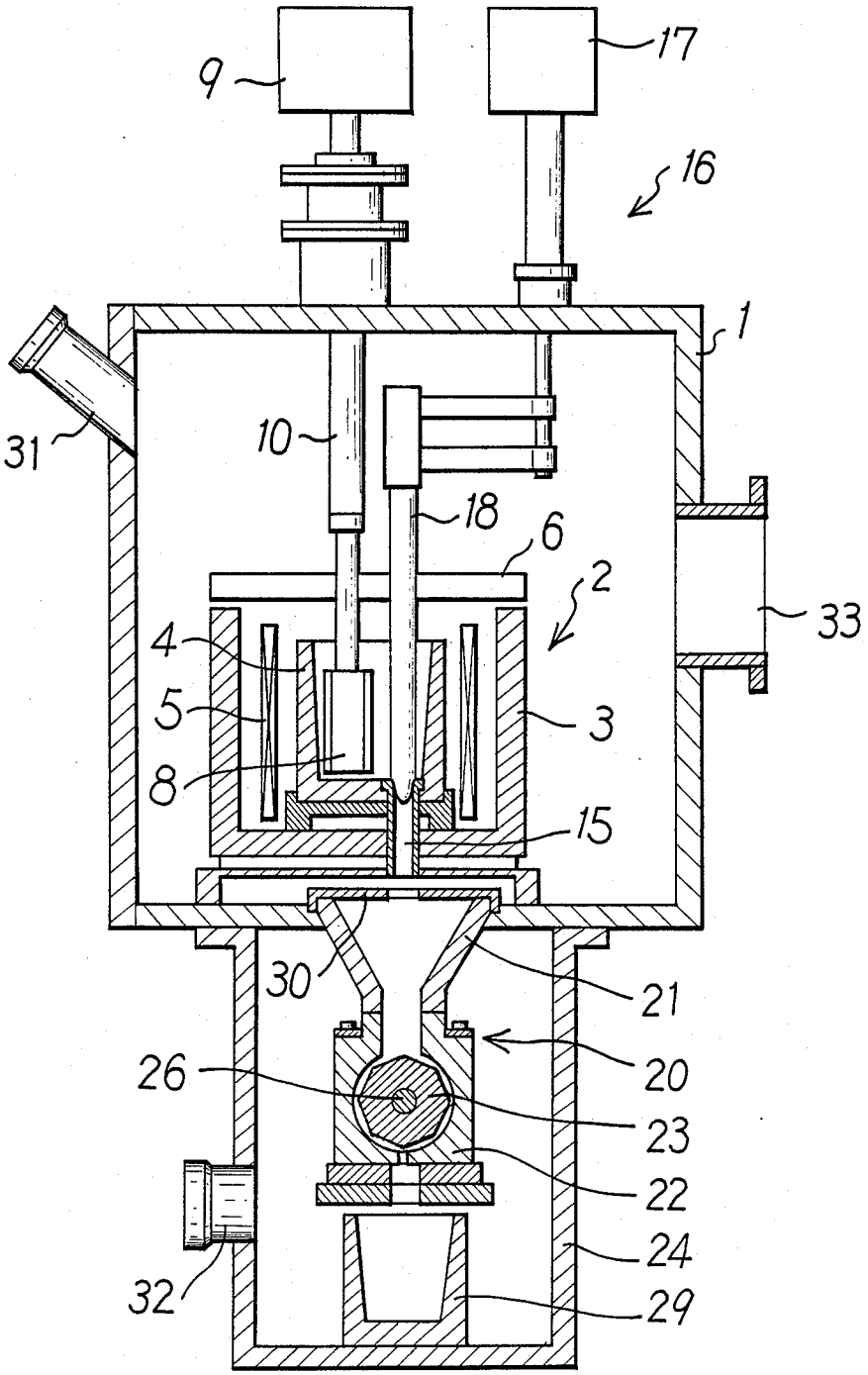
FIG. 2 is a cross-sectional side elevation of the apparatus shown in FIG. 1.

FIGS. 1 and 2 show a preferred embodiment of an apparatus for continuously making a composite material of a hypereutectic Al-Si alloy according to this invention.

The apparatus has a vacuum vessel 1 that contains a melting furnace 2 to melt a hypereutectic Al-Si alloy that serves as a matrix metal. The melting furnace 2 is enclosed in a case of heat-insulating material 3, has a crucible 4 surrounded by heaters 5 in the center thereof, and covered with a slidable shutter 6 actuated by cylinders not shown. A stirring blade assembly 8 inserted in the crucible 4 of the melting furnace 2 is cross-shaped in cross section, fastened to the tip of a rotating shaft 10 hermetically extending into the vacuum vessel from an external drive unit 9, such as an electric motor, and rotated at a low speed of 1,000 rpm or under by the drive unit 9. In the apparatus used in the experiment conducted by the inventor, the inside diameter of the crucible 4 was 160 mm and the largest diameter of the stirring blade assembly 8 was 140 mm.

An addition hopper 11 feeds a strengthening material of nonmetallic particles or fibers into the metal melted in the crucible 4 in the melting furnace 2. The addition hopper 11 consists of a strengthening material bucket 12 mounted outside the vacuum vessel 1 and a feed pipe 13 extended therefrom to above the crucible 4. The bucket 12 is provided with an airtight cover so that no excess air is admitted through the feed pipe 13. A taphole 15 to pour down the mixed and stirred composite material from the crucible 4 through the heat-insulating material 3 is provided in the bottom of the crucible 4. The taphole 15 has a taphole shutter 16 that is opened and closed from outside the vacuum vessel. The taphole shutter 16 consists of a rod plug 18 that is raised and lowered by a lifting motor 17.

The melting furnace 2 is an electric furnace that melts and feeds the matrix metal to a molten composite material stirrer 20 below. The stirrer 20 consists of a heat-resistant vessel 20 containing a rotor 23 and receives the molten composite material through a receiving funnel 21 disposed below the taphole 15. A container 24 holding the stirrer 20 inside is kept at a vacuum like the vacuum vessel 1 with which communication is maintained. A cooler to cool the molten bath may be provided to the heat-resistant vessel 22 in the stirrer 20 as required.

The rotor 23 refines the crystalline grains of the molten composite material and homogeneously disperses the strengthening material by mechanically stirring at high speed. The rotor 23 is positioned so that the molten metal falling from the taphole 15 drops substantially to the center thereof. To spatter off the molten composite material fed from the taphole 15, the rotor 23 has a polygonal cross section and turned at high speed by a rotor motor 25 which is connected thereto through a drive shaft 26. In the apparatus used in the experiment conducted by the inventor, the diameter of the largest portion of the rotor 23 was 140 mm. The rotor motor 25 rotates the rotor 23 at a speed between about 1,000 rpm and 30,000 rpm.

The heat-resistant vessel 22 containing the rotor 23 receives the molten composite material spattered by the turning rotor 23. While stirring the rapidly cooling composite material at high speed, the heat-resistant vessel 22 feeds the collected mass through a small-diameter hole 28 into a mold 29 placed therebelow. To assure the recovery of the molten material spattered by the rotor 23, a cover 30 having a feed hole in the center is mounted on the top of the receiving funnel 21.

In the figures, reference numerals 31 and 32 designate peep windows, 33 a vacuum suction port leading to a vacuum aspirator, and 34 a temperature control thermocouple.

To make a composite material of a hypereutectic Al-Si alloy having refined crystalline grains with the apparatus just described, the vacuum vessel 1 and the container 24 holding the molten composite material stirrer 20 inside are first evacuated to a vacuum of 1 to $1\times10^{-5}$ torr. Then, the alloy is melted in the crucible 4, and a strengthening material of nonmetallic particles or fibers is added into the molten alloy by means of the addition hopper 11. Then, the stirring blade assembly 8, which is rotated at low speed by the drive unit 9, homogeneously stirs the mixture. To achieve homogeneous mixing of the molten alloy and strengthening material, the stirring blade assembly is rotated at a low speed not higher than 1,000 rpm.

Examples of the suitable strengthening material of nonmetallic particles or fibers are particles of graphite and titanium carbide and short fibers of graphite. The amount of addition should preferably be held between 3 percent and 8 percent by weight.

The rotor motor 25 turns the rotor 23 at high speed. At the same time, the molten composite material thoroughly stirred by the stirring blade assembly 8 in the melting furnace 2 is poured down into the molten composite material stirrer 20 through the taphole 15 that is opened by actuating the taphole shutter 16.

Then, the molten composite material falls onto the rotating rotor 23 which repeatedly spatters droplets of the material against the inner wall of the heat-resistant vessel 22. Consequently, the spattered molten composite material becomes refined in grain size and rapidly cooled. The resulting viscous or semi-solid mass flows down along the inner wall of the heat-resistant vessel 22 and further through the small-diameter hole 28 into the mold 29 placed therebelow. Thus a semi-solid slurry of the compoiste material is continuously recovered. With the rotor 23 whose largest portion has a diameter of 140 mm, the surface speed thereof reaches 7 m/sec. to 220 m/sec. when turned by the rotor motor 25 at a high speed of about 1,000 rpm to 30,000 rpm. Practically, however, the speed need not be limited to the above range. The speed may be chosen from the range of 1 m/sec. to 1,000 m/sec. depending on the diameter of the rotor, which is enough to reduce the size of the crystallizing out primary silicon crystals to several microns and, at the same time, achieve homogeneous mixing of the alloy and strengthening material.

By the above stirring given by the rotor, such fine crystalline grains and homogeneous mixing of the alloy and the strengthening material of nonmetallic particles or fibers are achieved simultaneously in the casting process as are obtained by powder metallurgy. Furthermore, a material with excellent mechanical properties is produced continuously.

The following paragraphs describes an example of operation carried out with the apparatus shown in FIGS. 1 and 2.

After evacuating the vacuum vessel to a vacuum of approximately $1\times10^{-5}$ torr, a hypereutectic Al-Si alloy AC9A forindustrial use according to the Japanese Industrial Standards (JIS) was melted in the crucible. Then, 5 percent by weight of graphite particles was added as a strengthening material into the molten alloy from the addition hopper. The bath was homogeneously mixed by the stirring blade assembly rotated at low speed. The mixed molten composite material was poured through the opened taphole onto the rotor rotating at a high speed of 10,000 rpm.

The rotor rotating at high speed in the heat-resistant vessel spattered the molten composite material poured thereon in droplets and then stirred to reduce the crystalline grain size thereof. The resulting viscous or semi-solid mass of the composite alloy material was poured into a mold for continuous recovery.

FIG. 3 is a photomicrograph (magnification: 200X) showing the microstructure of a metal-matrix composite material thus obtained. Obviously, a homogeneous, finegrained microstructure, with primary silicon crystals as fine as several microns, comparable to that obtained by powder metallurgy is obtainable.

What is claimed is:

1. A method of making a composite material of a hypereutectic Al-Si alloy which comprises the steps of:

homogeneously mixing a strengthening material of nonmetallic particles or fibers with the hypereutectic Al-Si alloy melted in a melting furnace contained in a vacuum vessel by means of stirring blades rotated at low speed, dropping the obtained molten composite material of the hypereutectic Al-Si alloy onto a polygonal rotor that rotates a high speed about a horizontal shaft in a heat-resistant vessel, breaking up the primary silicon crystals being formed by spattering the molten composite material with said rotor rotating at high speed and cooling said molten composite material with a cooling means, receiving the spattered semi-fused composite material with said heat-resistant vessel, and making the composite material into a semi-solid mass having a fine-grained homogeneous microstructure by stirring the composite material with said rotor.

2. A method of making a composite material of a hypereutectic Al-Si alloy according to claim 1, in which the amount of the strengthening material added to the molten alloy is between 3 percent and 8 percent by weight.

3. A method of making a composite material of a hypereutectic Al-Si alloy according to claim 2, in which particles of graphite is used as the strengthening material of nonmetallic particles added to the molten alloy.

4. A method of making a composite material of a hypereutectic Al-Si alloy according to claim 2, in which particles of titanium carbide is used as the strengthening material of nonmetallic particles added to the molten alloy.

5. A method of making a composite material of a hypereutectic Al-Si alloy according to claim 2, in which fibers of graphite are used as the strengthening material of nonmetallic fibers added to the molten alloy.

6. A method of making a composite material of a hypereutectic Al-Si alloy according to claim 1, in which the surface speed of said rotor is set high enough to reduce the grain size of primary silicon crystals being formed to several microns and achieve homogeneous mixing of the alloy and strengthening material.

7. A method of making a composite material of a hypereutectic Al-Si alloy according to claim 6, in which the surface speed of said rotor is set between 1 m/sec. and 1,000 m/sec.

* * * * *

UNITED STATES PATENT AND TRADEMARK OFFICE

CERTIFICATE OF CORRECTION

PATENT NO. : 4,865,808

DATED : Sep. 12, 1989

INVENTOR(S) : Kiyoshi Ichikawa, et al

It is certified that error appears in the above-identified patent and that said Letters Patent is hereby corrected as shown below:

On the title page, item [54] and in column 1, lines 2 and 3:
The title is incorrectly recorded, "METHOD FOR MAKING HYPEREUTETIC AL-SI ALLOY COMPOSITE MATERIALS" should be:

--METHOD FOR MAKING HYPEREUTECTIC Al-Si ALLOY COMPOSITE MATERIAL--

Signed and Sealed this

Sixteenth Day of October, 1990

*Attest:*

HARRY F. MANBECK, JR.

*Attesting Officer*

*Commissioner of Patents and Trademarks*